US006188416B1

(12) United States Patent
Hayes

(10) Patent No.: US 6,188,416 B1
(45) Date of Patent: Feb. 13, 2001

(54) ORIFICE ARRAY FOR HIGH DENSITY INK JET PRINTHEAD

(75) Inventor: Donald J. Hayes, Plano, TX (US)

(73) Assignee: MicroFab Technologies, Inc., Plano, TX (US)

( * ) Notice: Under 35 U.S.C. 154(b), the term of this patent shall be extended for 0 days.

(21) Appl. No.: 08/799,554

(22) Filed: Feb. 13, 1997

(51) Int. Cl.[7] ..... B41J 2/295
(52) U.S. Cl. ..... 347/71
(58) Field of Search ..... 347/71, 45, 47

(56) References Cited

U.S. PATENT DOCUMENTS

| | | | | |
|---|---|---|---|---|
| 3,857,049 | | 12/1974 | Zoltan | 310/8.1 |
| 4,343,013 | * | 8/1982 | Bader et al. | 347/47 |
| 4,536,097 | | 8/1985 | Nilsson | 400/126 |
| 4,584,590 | | 4/1986 | Fischbeck et al. | 347/69 |
| 4,825,227 | | 4/1989 | Fischbeck et al. | 347/69 |
| 4,879,568 | | 11/1989 | Bartky et al. | 347/69 |
| 4,887,100 | | 12/1989 | Michaelis et al. | 347/69 |
| 5,227,813 | | 7/1993 | Pies et al. | 347/71 |
| 5,235,352 | | 8/1993 | Pies et al. | 347/71 |
| 5,334,415 | | 8/1994 | Hayes et al. | 427/231 |
| 5,345,256 | | 9/1994 | Stortz | 347/20 |
| 5,365,645 | | 11/1994 | Walker et al. | 29/25.35 |
| 5,373,314 | | 12/1994 | Everett et al. | 347/71 |
| 5,400,064 | | 3/1995 | Pies et al. | 347/68 |
| 5,402,162 | | 3/1995 | Fusting et al. | 347/43 |
| 5,406,319 | | 4/1995 | Hayes et al. | 347/71 |
| 5,414,916 | | 5/1995 | Hayes | 29/25.35 |
| 5,426,455 | | 6/1995 | Williamson et al. | 347/10 |
| 5,433,809 | | 7/1995 | Pies et al. | 156/268 |
| 5,435,060 | | 7/1995 | Hayes et al. | 29/890 |
| 5,436,648 | | 7/1995 | Stortz et al. | 347/10 |
| 5,444,467 | | 8/1995 | Stortz | 347/12 |
| 5,686,946 | * | 11/1997 | Mizutani | 347/68 |
| 5,703,631 | | 12/1997 | Hayes et al. | 347/47 |

* cited by examiner

*Primary Examiner*—John Barlow
*Assistant Examiner*—Christina Annick
(74) *Attorney, Agent, or Firm*—Locke Liddell & Sapp, LLP

(57) ABSTRACT

An ink jet printhead assembly for ink jet printing apparatus and a method for the manufacture thereof. The piezoelectrically operable ink jet printhead assembly has two arrays of driving channels aligned with a single orifice array in which each orifice connects through a fluid channel to a single driving channel.

5 Claims, 6 Drawing Sheets

ORIFICE ARRAY FOR HIGH DENSITY INK JET PRINTHEAD

BACKGROUND OF THE INVENTION

1. Field of the Invention

The present invention relates generally to an ink jet printhead assembly for ink jet printing apparatus and a method for the manufacture thereof. More particularly, the present invention relates to a piezoelectrically operable ink jet printhead assembly having two arrays of driving channels aligned with a single orifice array in which each orifice connects through a fluid channel to a single driving channel.

2. Description of the Prior Art

Ink jet printing systems use the ejection of tiny droplets of ink to produce an image. The devices produce highly reproducible and controllable droplets. Most commercially available ink jet printing systems may be classified as "continuous jet" or "drop-on-demand" systems. In continuous jet systems, droplets are continuously ejected from the printhead and either directed to or away from the paper or other substrate depending on the desired image to be produced. In drop-on-demand systems, droplets are ejected from the printhead in response to a specific command related to the image to be produced.

Drop-on-demand printing systems are based upon the production of droplets by thermal or electromechanically induced pressure waves. In one type of electromechanical printing system, a volumetric change in the fluid to be printed is induced by the application of a voltage pulse to a piezoelectric material which is directly or indirectly coupled to the fluid. This volumetric change causes pressure/velocity transients to occur in the fluid which are directed to produce a droplet that issues from an orifice in the printhead. According to such drop-on-demand printing systems voltage is applied only when a droplet is desired.

The use of piezoelectric materials in ink jet printers is well known. Most commonly, piezoelectric material is used in a piezoelectric transducer by which electric energy is converted into mechanical energy by applying an electric field across the material, thereby causing the piezoelectric material to deform. This ability to deform piezoelectric material has often been utilized in order to force the ejection of ink from the ink-carrying passages or channels of ink jet printers. Illustrative patents showing the use of piezoelectric materials in ink jet printers include U.S. Pat. Nos. 3,857,049, 4,584,590, 4,825,227, 4,536,097, 4,879,568, 4,887,100, 5,227,813, 5,235,352, 5,334,415, 5,345,256, 5,365,645, 5,373,314, 5,400,064, 5,402,162, 5,406,319, 5,414,916, 5,426,455, 5,430,470, 5,433,809, 5,435,060, 5,436,648 and 5,444,467.

In a representative configuration of a piezoelectrically actuated ink jet printhead, the ink jet printhead has, within its body portion, a single internal array of horizontally spaced, parallel ink receiving channels. The internal channels are covered at their front ends by a plate member through which a spaced series of small ink discharge orifices are formed. Each channel opens outwardly through a different one of the spaced orifices.

A spaced series of internal piezoelectric wall portions of the printhead body (typically formed from a piezoceramic material such as lead zirconate titanate "PZT") separate and laterally bound the channels along their lengths. To eject an ink droplet through a selected one of the discharge orifices, the two printhead sidewall portions that laterally bound the channel associated with the selected orifice are piezoelectrically deflected out of and then into the channel and then returned to their normal undeflected positions. The inward driven deflection of the opposite channel wall portions increases the pressure of the ink within the channel sufficiently to force a small quantity of ink, in droplet form, outwardly through the discharge orifice.

It can readily be seen that it would be highly desirable to provide an ink jet printhead, of the general type described above, in which the discharge orifice density (i.e., the number of ink discharge orifices per inch) is doubled without correspondingly doubling the size the printhead or the total number of components needed to fabricate the printhead. It is accordingly an object of the present invention to provide such an ink jet printhead.

SUMMARY OF THE INVENTION

The present invention is directed to a high discharge orifice density ink jet printhead having a plate member with a single orifice array. Preferably, the orifices are oriented in a single line and centered on the plate member. Each orifice in the plate member connects through a fluid channel to a single driving channel in the ink jet printhead.

In a preferred embodiment of the present invention, the ink jet printhead comprises a printhead body subassembly comprising a first piezoelectrically deflectable block structure having first and second opposite sides and a front end, first and second layers of a metallic material respectively disposed on the first and second block structure sides, and first and second sheets of a piezoelectrically deflectable material respectively secured to front end portions of the outer sides of the first and second metallic layers. The first block structure is preferably a unitary block structure.

The first block structure includes a first and second spaced series of elongated, parallel exterior surface grooves disposed on the first and second sides of the first block structure, respectively. The grooves laterally extend into the first and second sides of the first block structure, through the piezoelectric sheets and the associated metallic layers, and have open outer sides and front ends.

Second and third piezoelectric blocks are respectively secured to the outer sides of the first and second piezoelectric sheets, cover the outer sides of the grooves, and form with the grooves first and second series of driving channels disposed within the body of the printhead and are laterally bounded along their lengths, on opposite sides thereof, by first and second series of piezoelectrically deflectable side wall segments of the subassembly.

A cover or plate member is secured to the front end of the printhead body, over the front ends of the first and second series of driving channels, and has an array of ink discharge orifices formed therein and operatively communicated with the front ends of the first and second series of driving channels. The plate member preferably comprises a nonwetting coating on the outside surface thereof.

The rear ends of the driving channels are sealed and an ink supply is in fluid communication with the first and second series of driving channels. The segments of the metallic layers remaining after the grooves are formed therethrough are used as electrical leads through which driving signals may be transmitted to the channel side wall sections to piezoelectrically deflect selected opposing parts thereof in a manner to discharge ink from the channel which they laterally bound through the discharge orifice associated with such channel.

According to a preferred embodiment of the present invention, the first and second series of grooves, and thus the first and second series of driving channels are laterally displaced so that the number of orifices per inch in the plate member is twice the number of driving channels per inch in the printhead body.

According to another preferred embodiment of the present invention, a method is provided for forming a cover or plate member for an ink jet printhead having an array of ink discharge orifices formed therein.

BRIEF DESCRIPTION OF THE DRAWINGS

Other advantages and features of the invention will become more apparent with reference to the following detailed description of presently preferred embodiments thereof in connection with the accompanying drawings, wherein like reference numerals have been applied to like elements, in which.

DESCRIPTION OF THE PREFERRED EMBODIMENT

Figure 1:
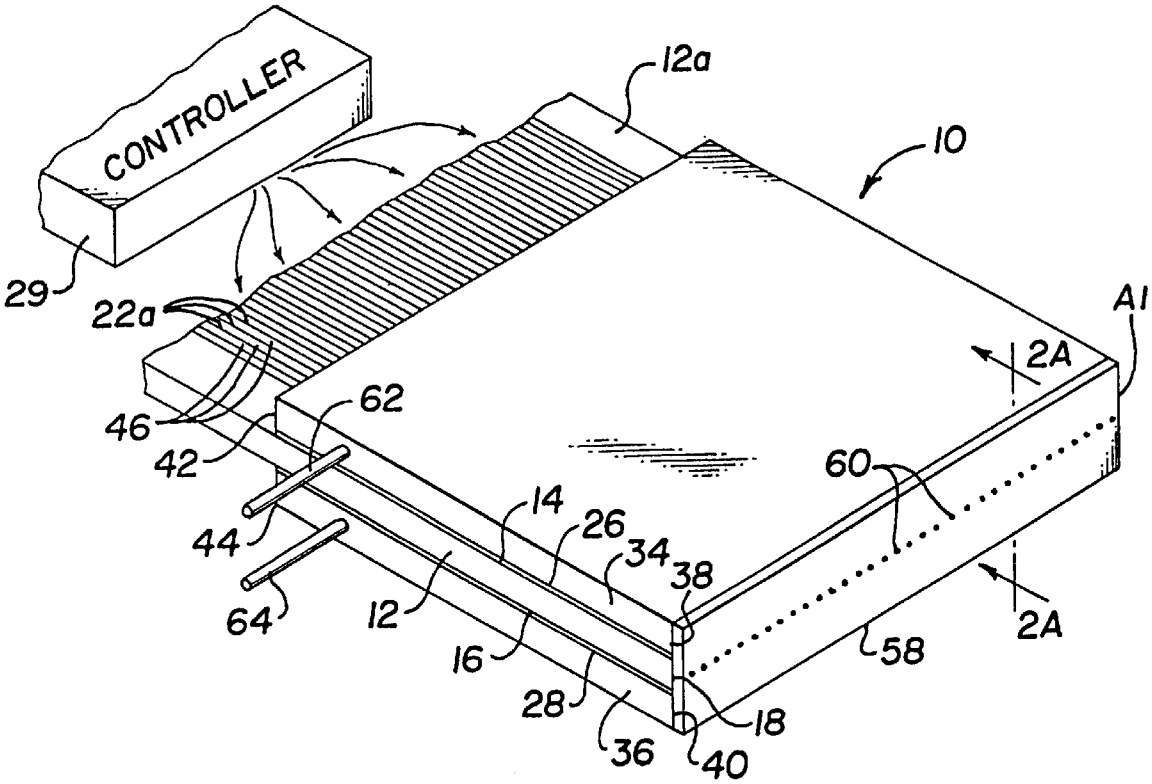
FIG. 1 is a perspective view of a schematically illustrated ink jet printhead according to the present invention.

Referring now to the drawings wherein thicknesses and other dimensions have been exaggerated in the various figures as deemed necessary for explanatory purposes and wherein like reference numbers designate the same or similar elements throughout the several views, an ink jet printhead 10 according to the present invention is shown in FIG. 1. The ink jet printhead 10 may be used in connection with the devices disclosed and claimed in U.S. Pat. Nos. 5,227,813, 5,235,352, 5,334,415, 5,345,256, 5,365,645, 5,373,314, 5,400,064, 5,402,162, 5,406,319, 5,414,916, 5,426,455, 5,430,470, 5,433,809, 5,435,060, 5,436,648 and 5,444,467, the entire disclosures of which are hereby incorporated herein by reference. As shown in FIG. 1, the ink jet printhead 10 includes a body portion 12 having a top side 14, a bottom side 16, and a front end 18. The body portion 12 may be formed from materials well known to those of ordinary skill in the art such as piezoceramic material including an active poled piezoelectric material, such as lead zirconate titanate (PZT), polarized in the direction indicated by the arrows 20 in FIGS. 2A, 2B and 2C.

Figure 2A:
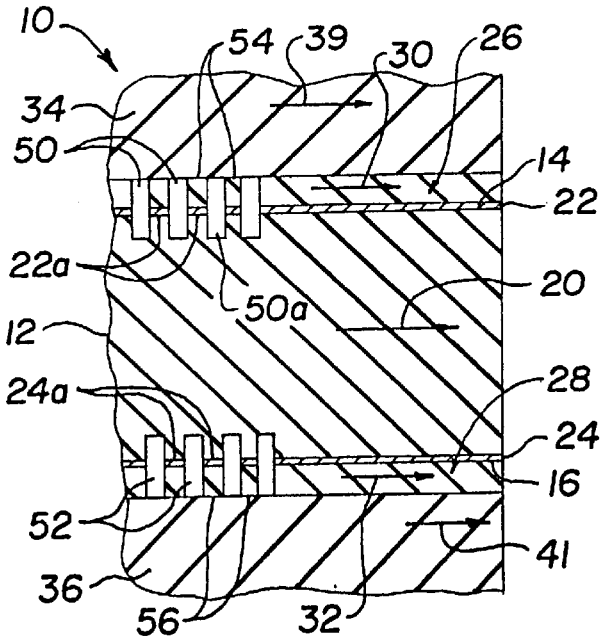
FIG. 2A is an enlarged partial cross-sectional view of a first embodiment of the ink jet printhead of FIG. 1 taken along line 2—2.

As shown in FIG. 2A, thin layers 22 and 24 of a metallic material are disposed on the top side 14 and bottom side 16, respectively, of the body portion 12, and relatively thin sheets 26 and 28 of PZT are respectively disposed on the outer side surfaces of front portions of the metallic layers 22 and 24. The PZT sheets 26 and 28 are poled in the direction indicated by arrows 30 and 32 in FIG. 2A.

Also, as shown in FIG. 2A, top and bottom blocks 34 and 36 of PZT are disposed on the outer sides of the PZT sheets 26 and 28, respectively. Blocks 34 and 36 are laterally aligned with body portion 12 sandwiched therebetween, have front ends 38 and 40, respectively, which are aligned with the front end of the body portion 12, are poled in the direction indicated by arrows 39 and 41 in FIG. 2A, and have rear ends 42 and 44, respectively, that are aligned with one another and stop short of the rear end of the body portion 12. Accordingly, as best illustrated in FIG. 1, a portion 12*a* of the body portion 12 extends rearwardly beyond the top and bottom blocks 34 and 36.

Figure 2B:
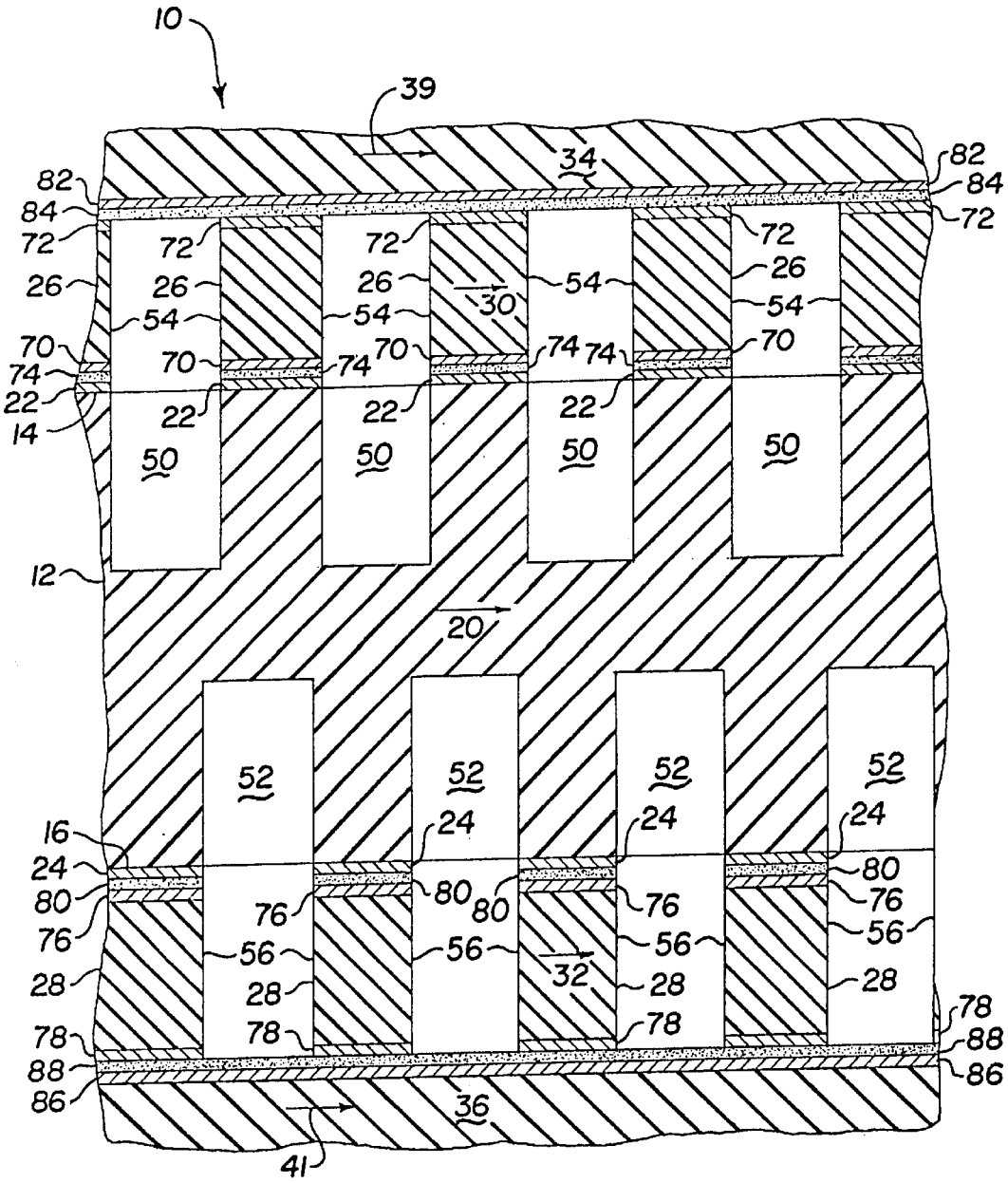
FIG. 2B is an enlarged partial cross-sectional view of a second embodiment of the ink jet printhead of FIG. 1 taken along line 2—2.

As shown in FIG. 2B, thin layers 22 and 24 of a metallic material are disposed on the top side 14 and bottom side 16, respectively, of the body portion 12. A relatively thin sheet 26 of PZT having thin layers 70, 72 of a metallic material is mounted on the outer side surface of the metallic layer 22. A first layer of a conductive adhesive 74, for example, an epoxy material, is provided to conductively attach the metallic layer 70 attached to the sheet of PZT 26 and the metallic layer 22 attached to the top side 14 of the body portion 12. A relatively thin sheet 28 of PZT having thin layers 76, 78 of a metallic material is mounted on the outer side surface of the metallic layer 24. A second layer of a conductive adhesive 80, for example, an epoxy material, is provided to conductively attach the metallic layer 76 attached to the sheet of PZT 28 and the metallic layer 24 attached to the bottom side 16 of the body portion 12. In each of the embodiments shown in FIGS. 2A and 2B the PZT sheets 26 and 28 are poled in the direction indicated by arrows 30 and 32.

Also, as shown in FIG. 2A, top and bottom blocks 34 and 36 of PZT are disposed on the outer sides of the PZT sheets 26 and 28, respectively.

As shown in FIG. 2B, top block 34 of PZT having a thin layer 82 of a metallic material is mounted on the outer side surface of the metallic layer 72. A third layer of a conductive adhesive 84, is provided to conductively attach the metallic layer 82 attached to the top block 34 of PZT and the metallic layer 72 attached to the sheet 26 of PZT. Also, as shown in FIG. 2B, bottom block 36 of PZT having a thin layer 86 of a metallic material is mounted on the outer side surface of the metallic layer 78. A fourth layer of a conductive adhesive 88, is provided to conductively attach the metallic layer 86 attached to the bottom block 36 of PZT and the metallic layer 78 attached to the sheet 28 of PZT.

Figure 2C:
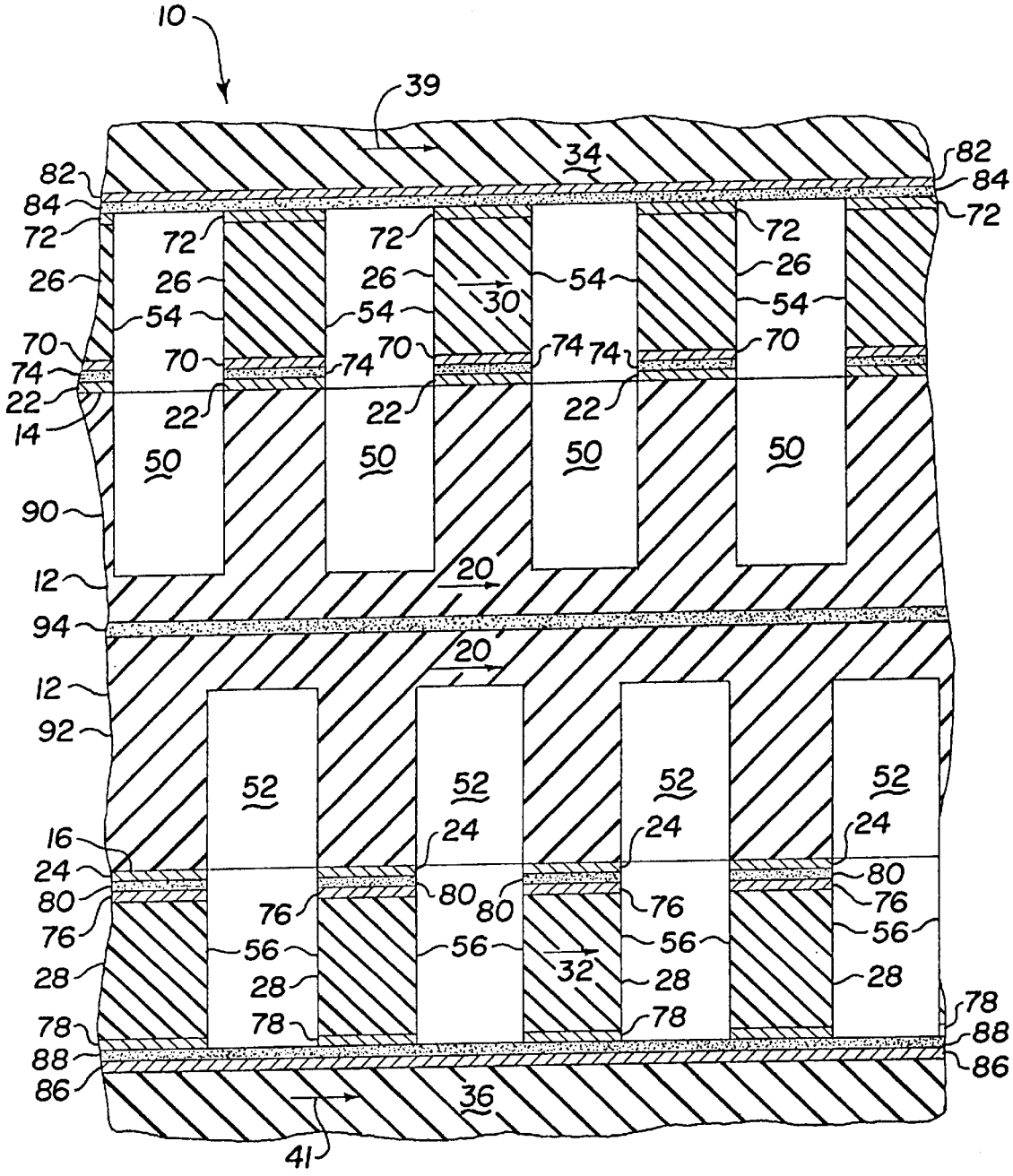
FIG. 2C is an enlarged partial cross-sectional view of a third embodiment of the ink jet printhead of FIG. 1 taken along line 2—2.

As shown in FIG. 2C, the body portion 12 is formed of a first body section 90 and a second body section 92. A fifth layer of an adhesive 94, for example, an epoxy material, is provided on the first body section 90 or the second body section 92. The fifth layer of an adhesive 94 enables the first body section 90 to be secured to the second body section 92.

In each of the embodiments shown in FIGS. 2A, 2B and 2C, blocks 34 and 36 are laterally aligned with body portion 12 sandwiched therebetween, have front ends 38 and 40, respectively, which are aligned with the front end of the body portion 12, are poled in the direction indicated by arrows 39 and 41, and have rear ends 42 and 44, respectively, that are aligned with one another and stop short of the rear end of the body portion 12. Accordingly, as best illustrated in FIG. 1, a portion 12*a* of the body portion 12 extends rearwardly beyond the top and bottom blocks 34 and 36.

Prior to the attachment of the top and bottom blocks 34 and 36 to the PZT sheets 26 and 28 or the metallic layers 72 and 78, spaced series of grooves 50 and 52 are respectively formed in the top and bottom sides of the body portion 12, through the metallic layers 22 and 24 and the PZT sheets 26 and 28 thereon, or through the metallic layers 22 and 24, the adhesive layers 74 and 80, through the metallic layers 70 and 76 and the PZT sheets 26 and 28 thereon, by means well known to those of ordinary skill in the art including precision dicing sawing such as disclosed in U.S. Pat. No. 5,414,916, the entire disclosure of which is hereby incorporated herein by reference. Grooves 50 and 52 are laterally displaced so that the walls of the body portion 12 and the PZT sheet 26 separating the grooves 50 are vertically aligned with the grooves 52, and the walls of the body portion 12 and the PZT sheet 28 separating the grooves 52 are vertically aligned with the grooves 50. Both sets of grooves 50 and 52 longitudinally extend from the front end of the body portion 12 to its rear end. After the formation of the grooves 50 and 52, elongated segments 22*a* of the top metal layer 22 are interdigitated with the grooves 50, and elongated segments 24*a* of the bottom metal layer 24 are interdigitated with the grooves 52. The metal layer segments 22*a* and 24*a* are used as electrical leads through which control signals are transmitted by means of controller 29 in FIG. 1 to cause the operative piezoelectric deflection of internal portions of the printhead body. Similar electrical connection is made to metal layer segments 22*a* and 24*a*.

After the top and bottom PZT blocks 34 and 36 are secured to the PZT sheets 26 and 28 they respectively cover the open sides of front portions of the grooves 50 and 52 to thereby form, within the printhead 10 a top series of interior driving channels 50 and a bottom series of interior driving channels 52. The driving channels 50 and 52 are sealed at the rear portions of the top and bottom PZT blocks 34 and 36, respectively.

Along their lengths the driving channels 50 are laterally bounded by opposing pairs of interior side walls 54 (see FIGS. 2A, 2B and 2C) each having in a vertically intermediate portion thereof a segment of the metallic layer 22 or segments of the metallic layer 22, the adhesive layer 74 and the metallic layer 70. In a similar manner, along their lengths the driving channels 52 are laterally bounded by opposing pairs of interior side walls 56 each having in a vertically intermediate portion thereof a segment of the metallic layer 24 or segments of the metallic layer 24, the adhesive layer 80 and the metallic layer 76.

Figure 3:
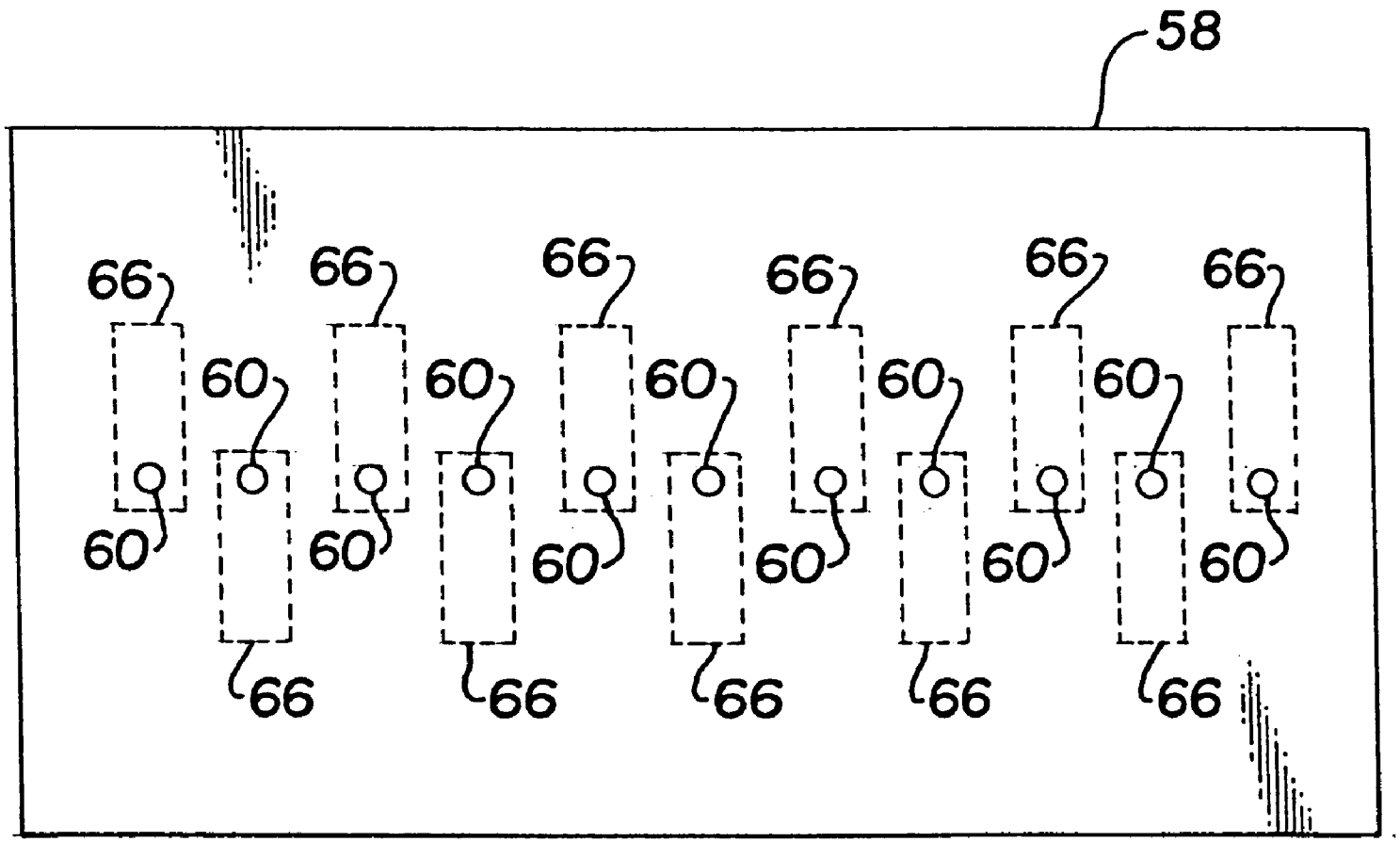
FIG. 3 is a side elevational view of a component of the ink jet printhead of FIG. 1.

A horizontally elongated orifice plate member 58 (see FIG. 1) is secured to the front ends 18, 38 and 40 of the body portion 12 and the top and bottom blocks 34 and 36, and has a single horizontally extending array $A_1$ of small diameter orifices 60 formed therethrough. Each of the orifices is in fluid communication with a different one of the driving channels 50 and 52. Ink manifolds (not shown) are interiorly formed within rear end portions of the top and bottom PZT blocks 34 and 36 and are supplied with ink from a suitable source thereof (not shown) via exterior ink supply conduits 62 and 64. The orifices 60, preferably, are tapered and may be formed according to methods well known to those of ordinary skill in the art, such as those disclosed in U.S. Pat. No. 5,208,980, the entire disclosure of which is hereby incorporated herein by reference. As shown in FIG. 3, the orifices 60 disposed in the horizontally elongated orifice plate member 58 (see FIG. 1) are generally cylindrical. Also, each orifice 60 is in fluid communication with a fluid channel 66 (shown in dotted lines) disposed on the obverse of the plate member 58. Each fluid channel 66 in turn is in fluid communication with one of the driving channels 50 and 52, thereby providing fluid ejection nozzles for the ink jet printhead 10.

The plate member 58 may be formed of any suitable material and may include one or more of the following commercially available materials: a polyimide material, polyethylene terephthalate, polybutylene terephthalate, polyesters, polyamides, cellulosic polymers, vinyl polymers, acrylic polymers, fluorinated polyethylenes, polyolefins, polyether ketones, polyoxazoles, polythiazoles, metallic films, metallized films, plates and glasses as are well known to those of ordinary skill in the art.

Figure 4A:
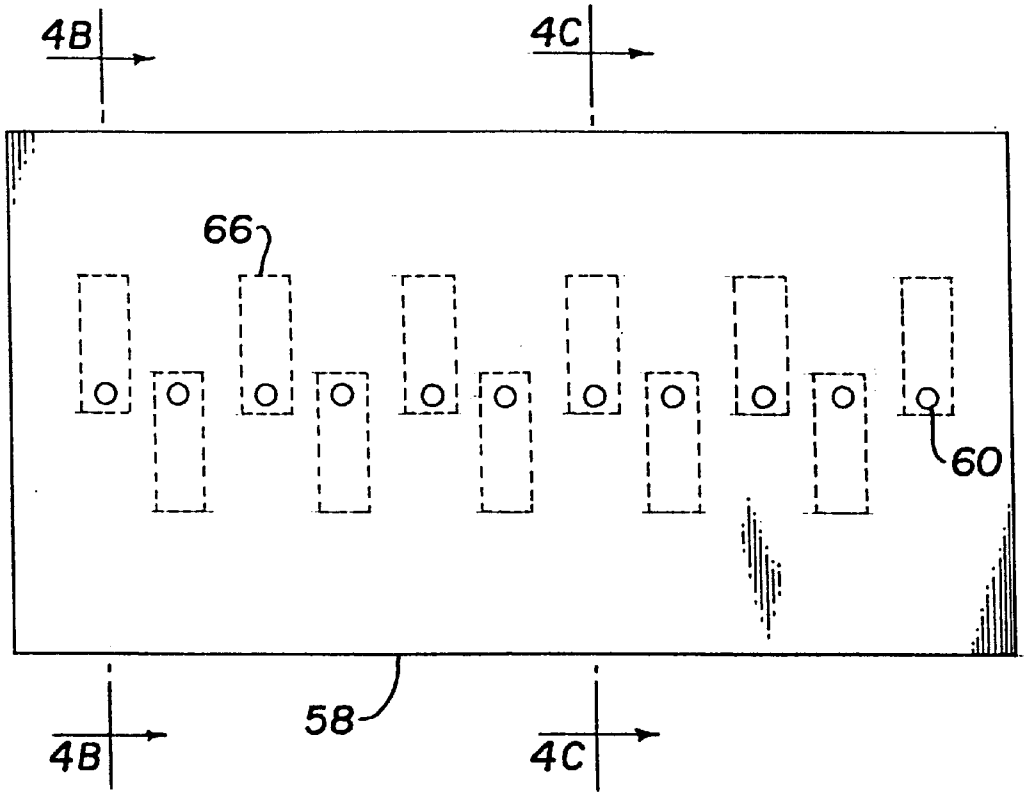
FIG. 4A is a side-elevational view of a component of the ink jet printhead of FIG. 1.
Figure 4B:
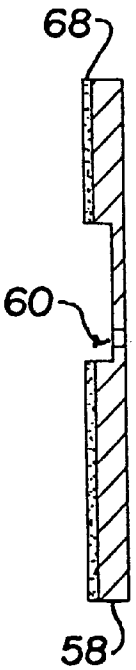
FIG. 4B is a cross-sectional view of the component of the ink jet printhead taken along line 4B—4B of FIG. 4A.

As shown in FIGS. 4A and 4B, the plate member 58 may be formed by applying a layer of adhesive 68, for example, an epoxy material, to a block of material suitable for forming the plate member 58.

A layer of backing material (not shown) is superposed on the adhesive layer 68 to protect the adhesive layer 68 during formation of the orifices 60 and fluid channels 66.

The orifices 60 and fluid reservoirs 66 may be formed in the plate member 58, adhesive 68 and backing material composite structure by removing portions of each of the backing material, adhesive 68 and plate member 58 according to any suitable technique well known to those of ordinary skill in the art such as by excimer laser ablation as disclosed in U.S. Pat. No. 5,208,980, the entire disclosure of which is incorporated herein by reference. According to the excimer laser ablation process, the laser energy is focused on the composite structure through a sequence of masks. FIG. 4A shows the plate member 58 and adhesive 68 structure after formation of the fluid channels 66 and orifices 60. FIG. 4B shows a cross-section of the fluid channels 66 and orifices 60 extending within the plate member 58.

Figure 5B:
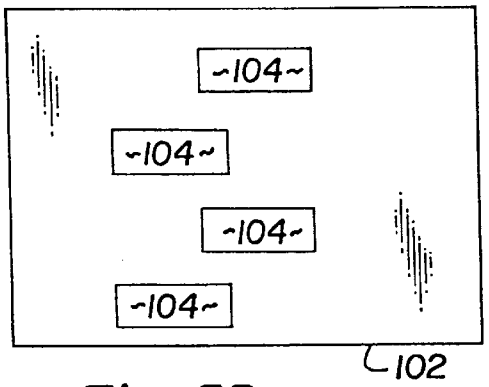
FIG. 5 which consists of FIGS. 5A–5F shows the ablation sequence for forming a component of the ink jet printhead of FIG. 1.
Figure 5D:
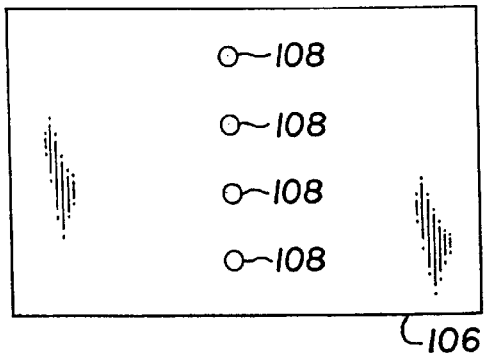
Figure 5A:
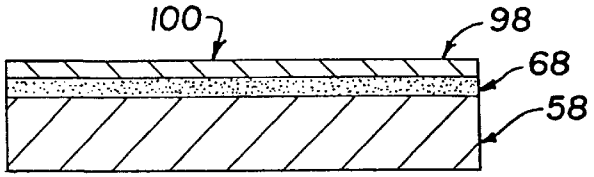
Figure 5C:
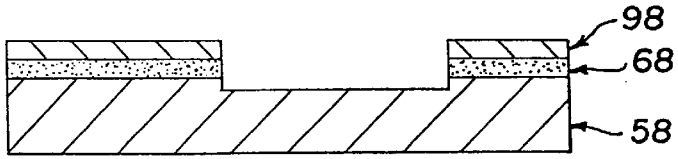
Figure 5E:
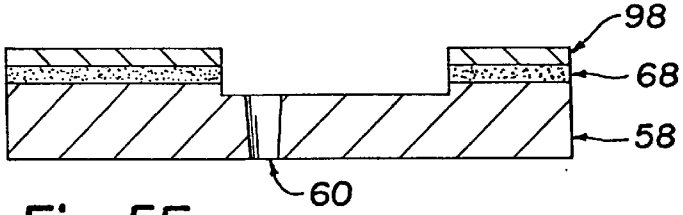

FIG. 5 shows the ablation sequence for forming the orifices 60 and fluid reservoirs 66 in the plate member 58, adhesive 68 and backing material 98 composite structure 100 shown in FIG. 5A. First, a mask 102 having openings 104 as shown in FIG. 5B, is superposed on the backing material 98 of the composite structure 100. Excimer laser energy is focused on the composite structure 100 through the openings 104 in the mask 102 to remove portions of the backing layer 98, adhesive 68 and plate member 58 to result in the structure shown in FIG. 5C. Next, a mask 106 having orifices 108 as shown in FIG. 5D, is superposed on the backing material 98 of the composite structure 100. Excimer laser energy is focused on the composite structure 100 through the orifices 108 to remove portions of the plate member 58 to form the orifices 60 in the plate member 58 and result in the structure shown in FIG. 5E.

Figure 5F:
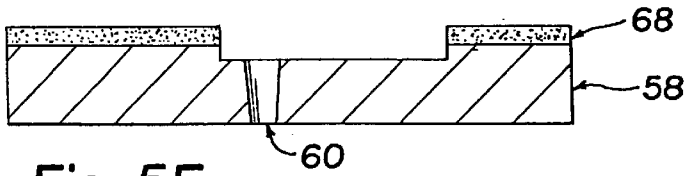

To mount the plate member 58 to the respective leading edges of the body portion 12, the thin metallic layers 22 and 24, the PZT sheets 26 and 28 and the top and bottom blocks 34 and 36, as well as the metallic layers 70, 72, 76, 78, 82 and 86 and the adhesive layers 74, 80, 84 and 88 (as appropriate) the remaining portions of the backing material layer 98 may be removed to expose the layer of adhesive 68 as shown in FIG. 5F. The exposed portions of the layer of adhesive 68 are then aligned with and superposed on the front end 18 of the body portion 12, the front ends of the thin metallic layers 22 and 24, the front end of the PZT sheets 26 and 28 and the front ends 38 and 40 of the top and bottom blocks 34 and 36, as well as the metallic layers 70, 72, 76, 78, 82 and 86 and the adhesive layers 74, 80, 84 and 88 (as appropriate).

Figure 4C:
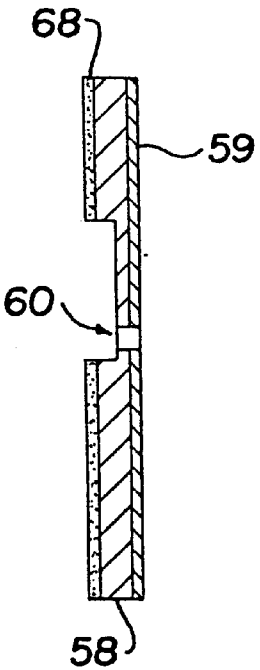
FIG. 4C is a cross-sectional view of the component of the ink jet printhead taken along line 4C—4C of FIG. 4A.

FIG. 4C shows an alternate embodiment of the plate member 58 which also includes a nonwetting coating 59 on the surface of the plate member 58 opposite the front ends 18, 38 and 40 of the body portion 12 and the top and bottom blocks 34 and 36. The nonwetting coating 59 may be formed of any suitable material and preferably may include commercially available modified polytetrafluoroethylene (Teflon®). Those of ordinary skill in the art will recognize that the nonwetting coating 59 may be selected from many other suitable nonwetting coating materials that are well known to those of ordinary skill in the art.

The ablation sequence discussed above with respect to FIG. 5 may also be used to form the cover plate 58 including the nonwetting coating 59 except that the composite structure 100 also includes the nonwetting coating 59 and the ablation step shown in FIG. 5D involves focusing excimer laser energy on the composite structure 100 through the orifices 108 in the mask 106 to remove portions of the plate member 58 and the nonwetting coating 59 to form the orifices 60 in the plate member 58.

During operation of the printhead 10 ink disposed within the driving channels 50 and 52 may be discharged through selected ones of the associated orifices 60 by transmitting electrical driving signals through the segments of the metallic layers 22 and 24, as well as the segments of the metallic layers 22 and 24, the adhesive layers 74 and 80 and the metallic layers 70 and 76 (as appropriate) to piezoelectrically deflect the interior side walls of the channels communicating with the selected orifices to cause the forward discharge of ink outwardly through the selected orifices.

For example, if it is desired to discharge ink in droplet form from an orifice 60 associated with the top channel 50*a* shown in FIG. 2A, appropriate electrical driving signals are transmitted through the pair of metallic lead segments 22*a* within the opposing interior side walls 54 that laterally bound the channel 50*a*. These driving signals are first used to piezoelectrically deflect the bounding pair of side walls 54 outwardly away from the selected channel 50*a*, and then reversed to piezoelectrically deflect the bounding pair of side walls 54 into the selected channel 50*a* to increase the ink pressure therein and responsively force a droplet of ink outwardly through the associated orifice 60. In a similar manner, electrical driving signals may be transmitted through associated pairs of the bottom metallic lead segments 24*a* to force ink, in droplet form, outwardly from a selected bottom channel 52 through its associated orifice 60.

Those of ordinary skill in the art will recognize that while the body portion 12 is shown in FIGS. 1, 2A and 2B as being formed from a unitary block of PZT material with grooves cut in the top and bottom of the block, the body portion 12 can also be formed by bonding together two blocks of PZT material each having grooves cut in one side thereof in which the grooves are misaligned such as is shown in FIG. 2C.

Those of ordinary skill in the art will recognize that compared to a conventionally configured ink jet printhead assembly having only a single driving channel array in its main piezoelectric block portion, the ink jet printhead 10 of the present invention advantageously provides a substantially higher discharge orifice density due to the fact that two laterally misaligned channel arrays are formed on opposite sides of the main printhead body portion defined by the main piezoelectric block 13, the metallic layers 22 and 24, and the opposite side sheets of piezoelectric material 26 and 28. The provision of these dual channel series in this manner substantially reduces the overall size of the printhead to create this substantially increased orifice density. The lateral displacement of the driving channels makes the printhead easier to make and use since alignment tolerances between the first and second series of driving channels 50 and 52 are reduced which consequently reduces print errors.

While the present invention has been described with reference to a presently preferred embodiment, it will be appreciated by those of ordinary skill in the art that various modifications, changes, alternatives and variations may be made therein without departing from the spirit and scope thereof as defined in the appended claims.

What is claimed is:

1. An ink jet printhead comprising:

a body section formed from a piezoelectric material having a first side and a second side, an actuating means disposed on said first side and second side, a first piezoelectric sheet disposed on said actuating means on said first side and a second piezoelectric sheet disposed on said actuating means on said second side wherein the first piezoelectric sheet is positioned at a top side and the second piezoelectric sheet is positioned at a bottom side of said body section;

the first piezoelectric sheet of the body section comprises a series of laterally spaced generally parallel driving channels extending into said body section;

the second piezoelectric sheet of said body section comprises a series of generally parallel driving channels extending into said body section, said bottom series of driving channels being laterally displaced with respect to said top series of driving channels;

a plate member mounted on said body section, said plate member having a plurality of laterally spaced orifices extending therethrough;

a plurality of fluid channels defined between said plate member and said body section, each fluid channel being in fluid communication with a corresponding one of said orifices and a corresponding one of said driving channels; and means for selectively generating an electric field and applying a pressure pulse to selected ones of said driving channels, whereby fluid in the fluid channel corresponding to the selected driving channel is ejected through the orifice in fluid communication with said fluid channel.

2. An ink jet printhead according to claim 1, wherein said body section comprises a first and second block of piezoelectric material and said first block of piezoelectric material is adhesively bonded to said second block of piezoelectric material.

3. An ink jet printhead according to claim 1, wherein each said driving channel extending into said body section on said first side is separated from an adjacent driving channel by an interior side wall;

wherein each said driving channel extending into said body section on said second side is separated from an adjacent driving channel by an interior side wall;

wherein each said driving channel on said first side of said body section is vertically aligned with an interior side wall on said second side of said body section; and wherein each said driving channel on said second side of said body section is vertically aligned with an interior side wall on said first side of said body section.

4. An ink jet printhead according to claim 3, wherein said orifices in said cover are horizontally aligned.

5. An ink jet printhead according to claim 1, wherein said cover comprises a nonwetting coating disposed on a surface of said cover opposite said body section.

* * * * *

UNITED STATES PATENT AND TRADEMARK OFFICE

CERTIFICATE OF CORRECTION

PATENT NO. : 6,188,416
DATED : February 13, 2001
INVENTOR(S) : Donald J. Hayes

It is certified that error appears in the above-identified patent and that said Letters Patent is hereby corrected as shown below:

Col. 8, line 62
replace "cover"
with --plate member--.

Col 8, line 64
replace "cover"
with --plate member--.

Col. 8, line 65
replace "cover"
with --plate member--.

Signed and Sealed this

Fifth Day of June, 2001

Nicholas P. Godici

NICHOLAS P. GODICI

*Acting Director of the United States Patent and Trademark Office*

*Attest:*

*Attesting Officer*